US008429922B2

(12) United States Patent
Freeman

(10) Patent No.: US 8,429,922 B2
(45) Date of Patent: Apr. 30, 2013

(54) ATTIC COOLING PROCESS AND APPARATUS

(76) Inventor: Jimmy L. Freeman, Jacksonville, FL (US)

( * ) Notice: Subject to any disclaimer, the term of this patent is extended or adjusted under 35 U.S.C. 154(b) by 640 days.

(21) Appl. No.: 12/590,421

(22) Filed: Nov. 9, 2009

(65) Prior Publication Data

US 2011/0107786 A1 May 12, 2011

(51) Int. Cl.
*F25D 17/04* (2006.01)
*B23P 15/26* (2006.01)
*F24F 13/08* (2006.01)

(52) U.S. Cl.
USPC ..... 62/89; 62/428; 62/263; 62/271; 454/289; 454/250; 454/260; 454/284; 454/254

(58) Field of Classification Search ..... 62/89, 428, 62/506, 507, 16, 91, 259, 263, 271; 165/74, 165/1, 53–57, 47, 48.1, 77–78; 454/289, 454/355, 350, 347, 254, 309, 250, 260, 284, 454/264, 265, 266, 267
See application file for complete search history.

(56) References Cited

U.S. PATENT DOCUMENTS

| | | | | | |
|---|---|---|---|---|---|
| 2,682,757 | A * | 7/1954 | Borgerd | 62/259.1 |
| 2,769,320 | A * | 11/1956 | Kuhlenschmidt et al. | 62/427 |
| 2,770,955 | A * | 11/1956 | Lundstrum | 62/259.1 |
| 3,302,549 | A * | 2/1967 | Tibbitts et al. | 454/265 |
| 4,204,409 | A * | 5/1980 | Satama | 62/271 |
| 4,667,584 | A * | 5/1987 | Koyama et al. | 99/280 |
| 4,815,530 | A * | 3/1989 | Scott | 165/134.1 |
| 4,870,832 | A * | 10/1989 | Crawley | 62/89 |
| 5,158,486 | A * | 10/1992 | Tamame | 62/506 |
| 8,062,108 | B2 * | 11/2011 | Carlson et al. | 454/369 |
| 2006/0025067 | A1 * | 2/2006 | Koessler | 454/359 |

* cited by examiner

*Primary Examiner* — Allen Flanigan
*Assistant Examiner* — Claire Rojohn, III
(74) *Attorney, Agent, or Firm* — William M. Hobby, III

(57) ABSTRACT

A process and apparatus for improving the cooling of the attic of a building by increasing the air flow therethrough includes the use of an air diverter attached to an A/C condenser unit casing partially around the exhaust fan opening in the casing for directing air from the exhaust fan into an air stream through open space towards a building soffit. A separate air hood mounted to the building soffit captures the air stream and directs it through the soffit into the attic.

6 Claims, 2 Drawing Sheets

ATTIC COOLING PROCESS AND APPARATUS

BACKGROUND OF THE INVENTION

The present invention relates to the cooling of a building having an attic and especially a process and apparatus for increasing the flow of air through an attic for cooling the attic and removing additional moisture from the attic.

In the past, it has been common to provide a building with an attic under the roof of the building and to provide air flow to remove heated air from the attic. Small openings in the soffit under the eaves of the roof allows air into the attic. The heat buildup in the attic is partially removed by a roof vent placed on the roof to vent the heated air from the roof. Thus, air entering the soffit vents under the eaves brings air into the attic and is vented out the roof vent by the rising heat within the attic. This flow of air also reduces moisture buildup and condensation within the attic. Cooling of the attic and of the house can be improved by the use of a thermostat controlled electric fan placed through the roof or through a gable which is activated only when the temperature reaches a predetermined level within the attic.

Attic ventilation can be very important in a home since air trapped in an unvented attic can get as hot as 150 degrees, which heat can seep into the living quarters below to warm the house and make the air conditioner work harder and require additional electric power. It has been shown in the past that the power required by an air conditioned home can be reduced by as much as 30% by properly venting and cooling the air within the attic.

One prior U.S. Patent to Crawly, U.S. Pat. No. 4,870,832, is for a positive ventilation cooling augmenter which uses a large open ended air collector attachment above an external heat exchanger for a residential air conditioner to duct the exhaust heat from the heat exchanger air flow into the attic of the building through a substantially vertically ascending flow tube. The heated air from the exhaust fan is forced directly into the attic in order to cool the household attic by displacing air trapped within the attic and to reduce the heat load in the air conditioned spaces of the house by reducing the heat radiated from the attic spaces downward through the ceiling of the house.

In U.S. Pat. No. 4,204,409 to Satama, an air conditioning apparatus and system directs air conditioning condense exhaust through the exterior wall air space and into the attic to reduce the heat load of the air conditioning system.

The present invention is directed towards using the exhaust air from the exhaust fan of an air conditioning condenser unit to provide an improved air flow through the attic in order to help cool the building and reduce the air conditioning load on the building. The exhaust fan of the standard air conditioning unit is typically directed towards the building soffit under the eave. The use of a diverter member to direct the exhaust air through open air space allows the air to be partially cooled when passing through open space. The air is then captured by a hood mounted on the soffit which surrounds an enlarged opening through the soffit and into the attic. This simplified system has been shown to be an effective improvement in reducing the energy load on the building and assists in cooling the building.

SUMMARY OF THE INVENTION

A process for cooling an attic of a building by increasing the air flow therethrough includes the steps of selecting an air diverting member, which may be shaped like a reverse scoop, and attaching it to a A/C condenser unit casing partially around the exhaust fan opening in the casing for directing air from the exhaust fan into an air stream in open space towards a building soffit. The steps include making an enlarged opening through the building soffit and into the building attic and selecting an air hood sized to partially surround the building soffit enlarged opening. The selected air hood is attached partially around the building soffit enlarged opening and is positioned to capture air from the air stream formed by the diverting member from the condenser fan exhaust air and directs the air into the building attic through the opening in the soffit. Thus, forced air from a condenser exhaust fan is directed into a building attic to provide forced air flow through the attic. The step of attaching the diverting member to the condenser unit casing includes attaching a pair of brace members between the diverting member and the condenser casing with threaded fasteners. The diverter member is shaped like an inverted scoop or similar to an arcuate open cone section.

An apparatus for cooling the attic of a building by increasing the air flow therethrough includes an A/C condenser unit having a casing and having an exhaust fan directing air from an opening in the casing. The condenser unit is positioned adjacent a building having an attic therein and having a roof having a soffit having a vent opening therein. An air diverter member is attached to the A/C condenser casing adjacent the fan opening therein for directing the exhaust fan air and is shaped to fit partially therearound for directing air from the exhaust fan toward the roof soffit. A diverter member has a generally arcuate tapered shape for directing an air stream through open space towards the roof soffit and is attached to the condenser casing with a pair of bracing members. An air hood is attached partially around the roof soffit opening therein and positioned for receiving air from the exhaust fan directed thereto from the air diverter member and into the attic to thereby provide a forced air flow through the attic without having to run ducting from the condenser unit to the attic.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
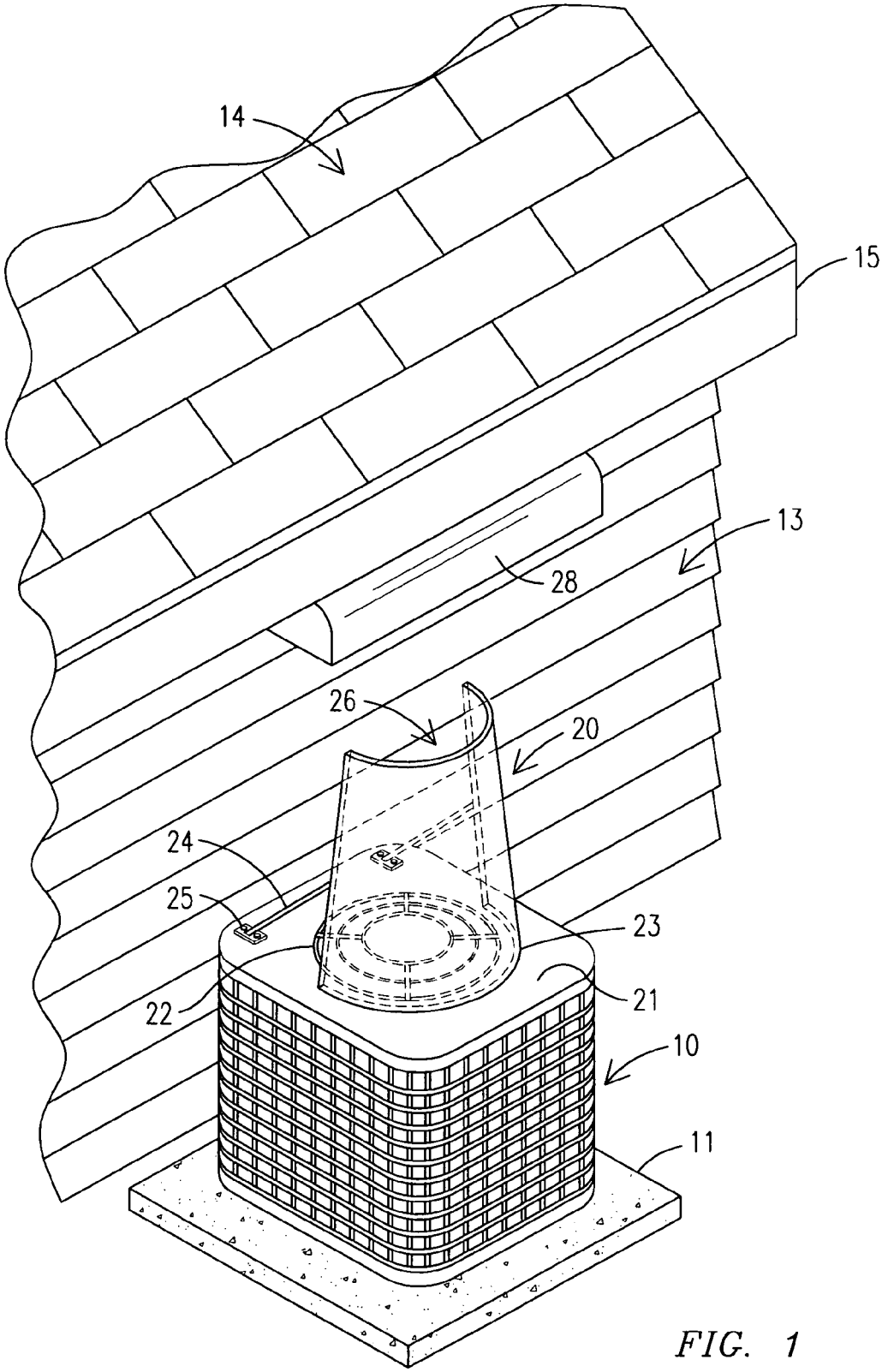
FIG. 1 is a perspective view of the present invention installed on a building.
Figure 2:
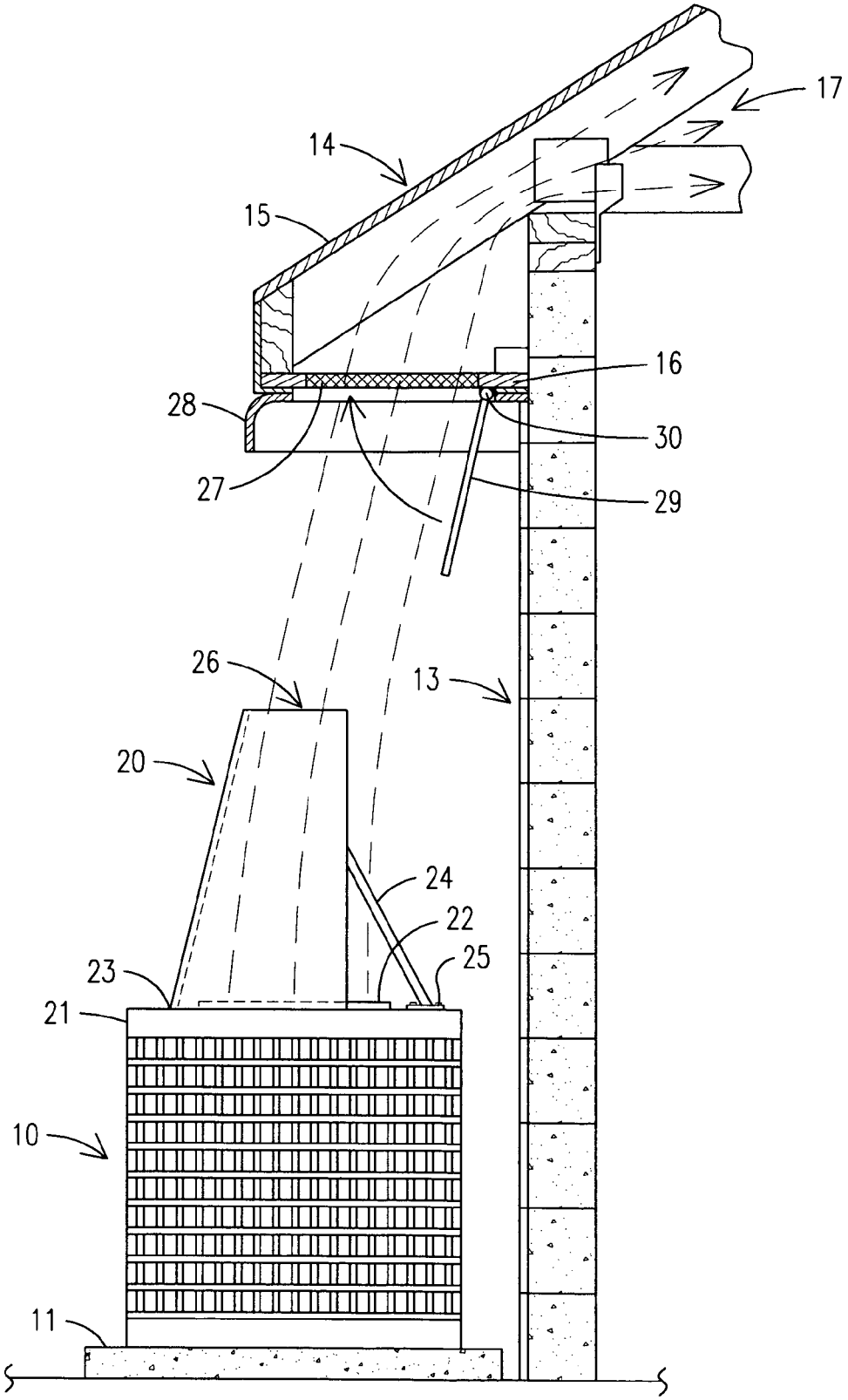
FIG. 2 is a sectional view of the system of FIG. 1.

The exemplary embodiment of the present invention can be seen in FIGS. 1 and 2 in which an air conditioning or heat pump condenser unit 10 is mounted to a base 11 adjacent a residential house or building 12. The building 12 has side walls 13 and a roof 14 having, eaves 15 having a soffit 16 thereunder. The building has an attic 17 in building 12. The soffit 16 typically has vents placed therein for the flow of air which is drawn into the attic 17 by the rising heat within the attic which is exhausted out of a roof vent. In some cases, powered roof vents may be used to exhaust additional air from the attic 17. Attics and buildings of this type have been shown to reach very high temperatures even when vented so that additional air flow not only reduces the heat load in the attic and the heat load on the air conditioning system. Venting also prevents condensation and moisture buildup within the attic.

The condenser unit 10 has an air diverter 20 attached thereto around the condenser unit casing 21 exhaust fan opening 22. The diverter member 20 is shaped like a reverse scoop or like an arcuate open section of a cone and has abase 23 having an arc to extend around the opening 22 and the condenser casing 21. The diverter has a pair of telescoping brace members 24 which are anchored with threaded fasteners 25 to the casing 21 and which may be adjusted to position the tilt of the diverter 20. The top or output 26 of the diverter 20 is aimed towards the bottom of the eave 15 and soffit 16. Soffit 16 has a screen covered opening 27 therethrough directly over the condenser 17 and has an air hood 28 mounted therearound and shaped to capture the air being directed thereat by the nozzle-like air diverter member 20. A door 29 is hinged with hinge 30 and can be closed to block diverted air from entering the opening, such as in cold weather.

The air diverter member 20 directs the air through open space thereby cooling the heated air being forced out of the condenser 10 prior to its reaching soffit 16 screen opening 27 and being directed into the attic 17' where the air pressure will force the heated air in the attic out an existing roof vent.

The advantage of the present invention is the simplicity of having only two components which are mounted to an existing building and air conditioning unit which will help reduce the heat load within the attic of the building in the case of buildings having roof eaves with a soffit thereunder. Thus, the present invention can be quickly and inexpensively attached to an existing building to reduce the energy load and the cost of electricity for cooling the building.

The process for the present invention includes the selecting of a diverting member 20 generally shaped like a reverse scoop or an arcuate and tapered section of a cone which diverter member 20 is attached to an A/C condenser unit casing partially around the exhaust fan opening 22. Diverter member 20 directs air from the exhaust fan into an air stream in open space towards the building soffit. The process includes making an enlarged opening 27 in the building soffit and into the building attic 17. An air hood 28 is selected to partially surround the building soffit enlarged opening and is attached to partially surround the building soffit enlarged opening in a position to capture air from the air stream formed by the diverter member. The condenser fan exhaust air is directed into the building attic through the soffit opening. Thus, forced air from a condenser exhaust fan is directed into a building attic to thereby provide an improved air flow through the attic. The process includes the step of attaching the diverter member into the condenser unit casing 21 using a pair of braces 24 threadedly attached to the casing with threaded fasteners 25.

It should be clear at this time that a process and apparatus for cooling the attic of a building by increasing the air flow therethrough using the forced air from the exhaust fan of a condensing unit without the need of ducts and which process and apparatus can be easily accomplished with a diverter member and a hood member directly capturing flow as it passes through open space to cool some of the exhaust air from an air conditioning condenser unit. However, the present invention is not to be construed as limited to the forms shown which are to be considered illustrative rather than restrictive.

I claim:

1. A process for cooling the attic of a building by increasing the air flow therethrough comprising:

selecting an air diverting member;

attaching said air diverting member to an A/C condenser unit casing partially around the exhaust fan opening in said casing for directing air from said exhaust fan into an air stream in the open air toward a building soffit;

making an enlarged opening through the building soffit and into the building attic aligned with said A/C condenser unit exhaust fan opening;

selecting an air hood sized to partially surround said building soffit enlarged opening; and attaching an air hood partially around said building soffit enlarged opening positioned to capture air from said air stream formed by said diverting member from said A/C condenser unit exhaust fan and directing the captured air into the building attic through said soffit opening;

whereby forced air from a condenser exhaust fan can be directed into a building attic to thereby provide forced air flow through said attic.

2. The process for cooling the attic of a building by increasing the air flow therethrough in accordance with claim 1 in which the step of attaching said diverting member to said condenser unit casing includes attaching a pair of brace members between said diverting member and said condenser casing.

3. The process for cooling the attic of a building by increasing the air flow therethrough in accordance with claim 2 in which the step of attaching said diverting member includes threadedly attaching each said brace member to said condenser casing.

4. The process for cooling the attic of a building by increasing the air flow therethrough in accordance with claim 3 in which the step of selecting a diverting member includes selecting a generally reverse scoop shaped diverting member.

5. The process for cooling the attic of a building by increasing the air flow therethrough in accordance with claim 1 including attaching a hinged door to said soffit for covering said enlarged opening in said soffit to thereby block air from said condenser fan during cold weather.

6. An apparatus for cooling the attic of a building by increasing the air flow therethrough comprising:

an A/C condenser unit having a casing and having an exhaust fan directing air from an opening in said casing, said condenser unit being positioned adjacent a building having an attic therein and having a roof having a soffit having a vent opening therein;

an air diverter member attached to said A/C condenser casing adjacent the opening therein for said exhaust fan air and shaped to fit partially therearound for directing air from said exhaust fan toward said roof soffit, said diverter member having a generally reverse scoop shape for directing an air stream into the open air towards said roof soffit, said air diverter member being attached to said condenser casing with a pair of bracing members; and an air hood attached partially around the roof soffit opening therein and positioned for receiving air from said exhaust fan directed thereto from said air diverter member into said attic to thereby provide a forced air flow through said attic.

* * * * *